US009246250B2

(12) United States Patent
Yoshiura et al.

(10) Patent No.: US 9,246,250 B2
(45) Date of Patent: Jan. 26, 2016

(54) ELECTRICAL CONNECTOR

(71) Applicant: SMK Corporation, Tokyo (JP)

(72) Inventors: Yasuo Yoshiura, Tokyo (JP); Ryo Sasaki, Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 14/546,461

(22) Filed: Nov. 18, 2014

(65) Prior Publication Data

US 2015/0140858 A1 May 21, 2015

(30) Foreign Application Priority Data

Nov. 21, 2013 (JP) ..... 2013-240720

(51) Int. Cl.

| | |
|---|---|
| ***H01R 13/60*** | (2006.01) |
| ***H01R 12/70*** | (2011.01) |
| ***H01R 12/50*** | (2011.01) |
| ***H01R 12/72*** | (2011.01) |
| ***H01R 13/502*** | (2006.01) |

(52) U.S. Cl.

CPC ..... *H01R 12/707* (2013.01); *H01R 12/721* (2013.01); *H01R 13/502* (2013.01); *H01R 23/7026* (2013.01)

(58) Field of Classification Search

CPC .. H01R 12/707; H01R 12/721; H01R 13/502; H01R 23/701; H01R 23/7015; H01R 23/7026

USPC ..... 439/79, 567

See application file for complete search history.

(56) References Cited

U.S. PATENT DOCUMENTS

| | | | | |
|---|---|---|---|---|
| 7,052,317 | B2 * | 5/2006 | Hara | H01R 12/7029 439/567 |
| 9,017,100 | B2 * | 4/2015 | Lai | H01R 12/7029 439/567 |
| 2011/0045693 | A1 * | 2/2011 | Uchida | H01R 13/658 439/567 |

FOREIGN PATENT DOCUMENTS

| | | |
|---|---|---|
| JP | H05-50690 U | 7/1993 |
| JP | H10-172632 A | 6/1998 |
| JP | H10-340767 A | 12/1998 |

* cited by examiner

*Primary Examiner* — Khiem Nguyen
(74) *Attorney, Agent, or Firm* — Locke Lord LLP

(57) ABSTRACT

Provided is an electrical connector without making the manufacturing process complicated and without increasing the size and the manufacturing cost, wherein, an electrical connector includes a holddown attached to a body part of a second insulating housing and fixed to a circuit board P. The holddown is formed of a single metal sheet, and includes a held part held by body part, leg parts extending from the held part, protruding from opposed faces facing the circuit board of the body part placed on the circuit board, and being fixed to the circuit board, and an extension part extending from the held part in a direction parallel to a direction in which a counterpart connector is engaged.

4 Claims, 7 Drawing Sheets

ELECTRICAL CONNECTOR

CROSS-REFERENCE TO RELATED APPLICATION

This application claims priority of Japanese Patent Application No. 2013-240720 filed Nov. 21, 2013, which is incorporated herein by reference in its entirety.

BACKGROUND

1. Technical Field

The present invention relates to an electrical connector having a holddown attached to a housing and fixed to a circuit board.

2. Related Art

In related art, electrical connectors mounted on circuit boards in engagement with counterpart connectors and adapted to fix fittings called holddowns attached to housings to the circuit boards on which the electrical connectors are mounted are known.

FIG. 12 is a perspective view of an electrical connector of the related art, and FIG. 13 is a perspective view of holddowns of the related art.

The electrical, connector 200 of the related art shown in FIG. 12 includes a housing 202 and a pair of holddowns 210. The electrical connector 200 also has an inner housing (not shown) to which a contact is attached in addition to the housing 202.

The housing 202 has a protrusion 201 that protrudes from a circuit board and engages with a counterpart connector when the electrical connector 200 is mounted on the circuit board. The housing 202 also has a pair of left and right grooves 203 open at the top surface.

The holddowns 210 each have a held part 211 having left and right ends bent toward the same side and held in the groove 203 of the housing 202, and a leg part 212 extending vertically from the held part 211 as shown in FIG. 13. The holddowns 210 are press-fitted into the grooves 203 of the housing 202 from above so that the held parts 211 are held in the grooves 203, and lower ends of the held parts 211 are in contact with inner bottom faces, which are not shown, of the grooves 203 so that the holddowns 210 are prevented from coming off the housing 202 downward. The leg parts 212 of the holddowns 210 protrude outward from the bottom face of the housing 202 and are fixed to the circuit board by soldering.

As a result of fixing the holddowns 210 held by the housing 202 to the circuit board as described above, the strength against a load such as prying force applied on the housing 202 when the counterpart connector is engaged with the housing 202 can be improved.

The electrical connector 200 of the related art shown in FIG. 12, however, has an eccentric center of gravity closer to the protrusion 201 and is thus tilted in the R direction in FIG. 12 when placed on the circuit board. The electrical connector 200 thus needs to be soldered in a state in which the electrical connector 200 is pressed with a jig or the like. In particular, the protrusion 201 needs to serve as a guide for insertion when the counterpart connector is engaged and to hold the counterpart connector so as not to come off after engagement, and thus needs to have a sufficient length in the protruding direction. The electrical connector 200 of the related art shown in FIG. 12 therefore has a problem that the center of gravity is likely to be closer to the protrusion 201.

In such circumstances, JP 10-340767 A and JP 10-172632 A disclose electrical connectors with a center of gravity adjusted when the electrical connectors are mounted on circuit boards so that tilting in soldering due to eccentricity of the center of gravity can be prevented.

Specifically, JP 10-340767 A discloses an electrical connector in which a connector body is accommodated in a housing in a state in which the connector body can slide in the front-back direction and a contact lead and a soldering lead provided in the connector body are connected by a flexible cable. In JP 10-340767 A, this allows adjustment of the center of gravity by sliding the connector body.

JP 10-172632 A discloses an electrical connector in which a balance weight is placed on a position opposite to the center of gravity of the entire housing in the front-back direction with respect to the center in the front-back direction of the bottom face of the housing in a mounted state. In JP 10-172632 A, this allows the center of gravity in the front-back direction of the housing to be adjusted closer to the center in the front-back direction of the bottom face in the mounted state, which allows the electrical connector to be stably mounted on a circuit board before soldering.

SUMMARY

In JP 10-340767 A, however, since a mechanism for moving the connector body is required, there is a problem that the entire structure of the connector is complicated and the manufacturing process is complicated.

In JP 10-172632 A, since a pair of balance weights for adjusting the center of gravity needs to be provided as additional components, there is a problem that the manufacturing cost increases with the increase in the number of components. Furthermore, in JP 10-172632 A, a fixing part having holes for inserting and removing screw- or nail-shaped balance weights needs to be additionally formed, and there is thus a problem that the entire connector becomes large.

An objective of the present invention is to provide an electrical connector without making the manufacturing process complicated and without increasing the size and the manufacturing cost.

An electrical connector according to the present invention includes: an insulating housing having a body part placed on a circuit board, and a protruding part protruding from the body part and adapted to be engaged with a counterpart connector; a conductive contact having a first connection part to be connected to a conductive terminal of the counterpart connector and a second connection part connected to a conductive part of the circuit board, and attached to the housing; and a holddown attached to the body part and fixed to the circuit board, wherein the holddown is formed of a single metal sheet, and includes a held part held by the body part, a leg part extending from the held part, protruding from an opposed face of the placed body part facing the circuit board, and being fixed to the circuit board, and an extension part extending from the held part in a direction parallel to a direction in which the counterpart connector is engaged.

As a result of attaching the holddown, which includes the held part, the extension part extending from the held part in the direction parallel to the direction in which the counterpart connector is engaged, to the body part of the housing, and shifting the center of gravity of the electrical connector forward in the direction in which the counterpart connector is engaged, the electrical connector can be stably mounted on the circuit board without pressing the electrical connector.

Furthermore, as a result of forming the holddown of a single metal sheet and attaching the holddown to the body part as a member for adjusting the center of gravity, the holddown can be made as a single member, an attachment part for attaching the holddown to the housing need not be additionally formed, and the holddown that is a member for fixing the electrical connector to the circuit board can also be used as a member for adjusting the center of gravity.

EFFECTS OF THE INVENTION

According to the present invention, a complicated manufacturing process can be avoided since no movable mechanism for adjusting the center of gravity is provided, and increase in the size and the manufacturing cost can be prevented by attaching a holddown formed of a single metal sheet as a member for adjusting the center of gravity.

DETAILED DESCRIPTION

Figure 1:
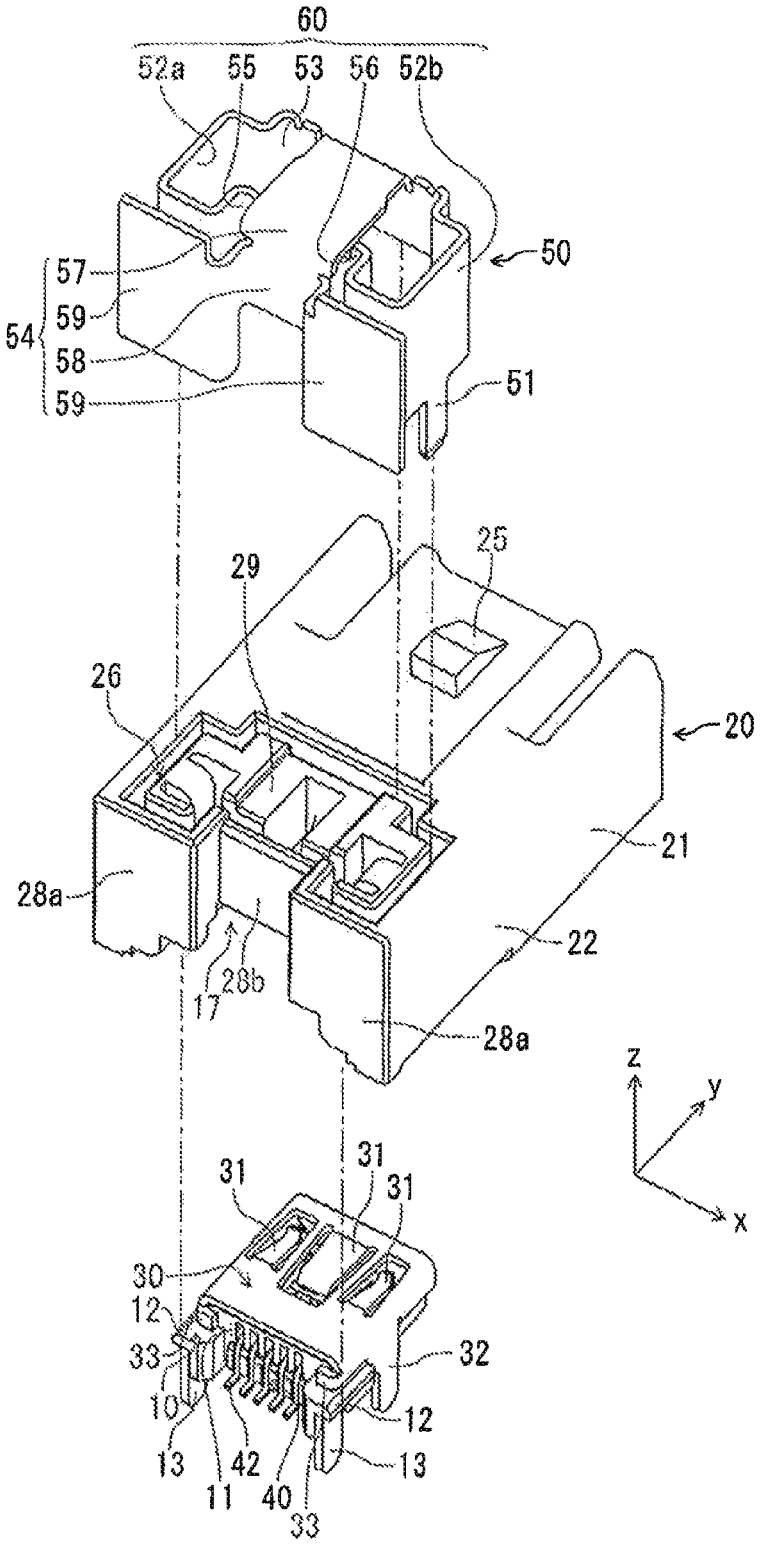
FIG. 1 is an exploded perspective view of an electrical connector according to an embodiment of the present invention as viewed from above and diagonally behind.
Figure 2:
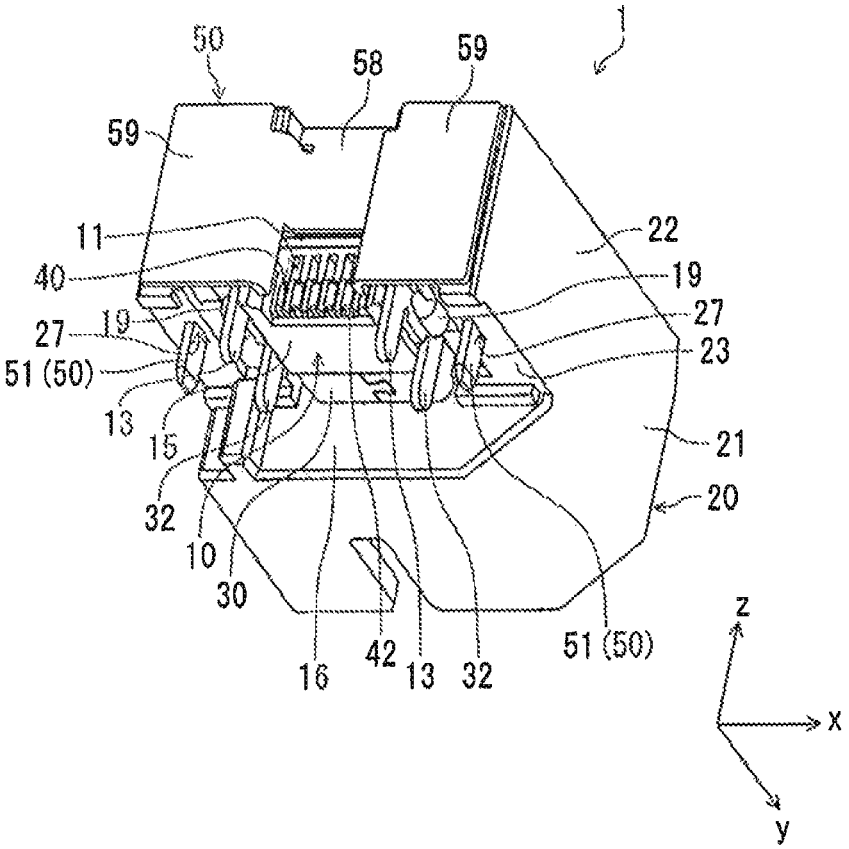
FIG. 2 is a perspective, view of the electrical connector according to the embodiment of the present invention as viewed from below and diagonally behind.
Figure 3:
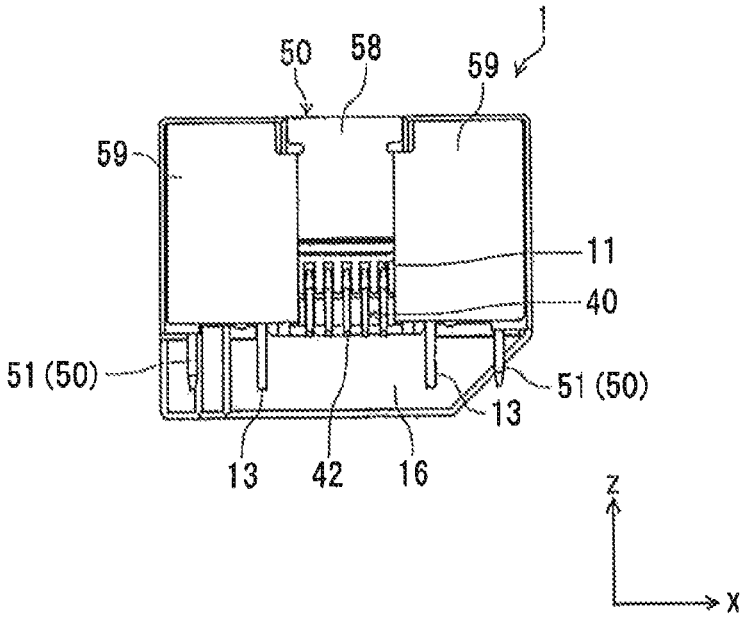
FIG. 3 is a rear view of the electrical connector according to the embodiment of the present invention.
Figure 4:
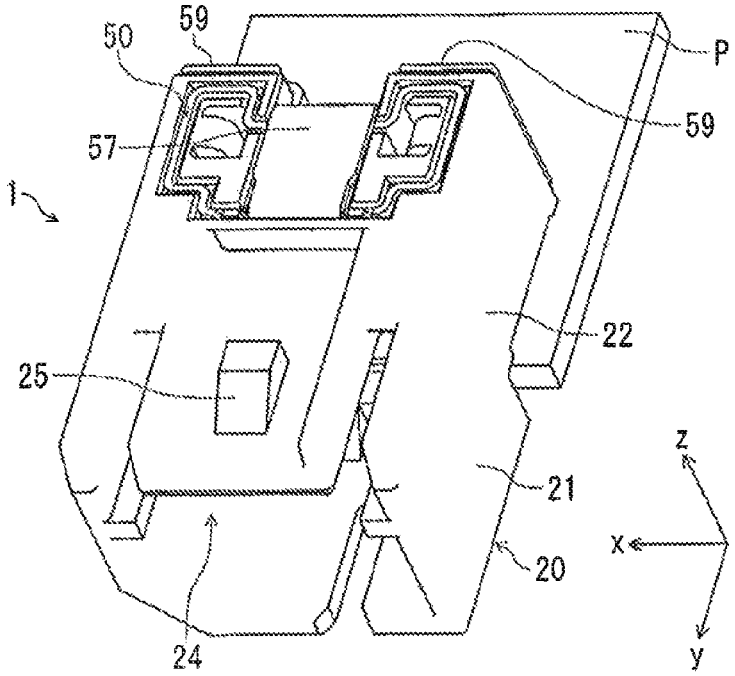
FIG. 4 is a perspective view of the electrical connector mounted on a circuit board according to the embodiment of the present invention as viewed from above and a diagonal front.
Figure 5:
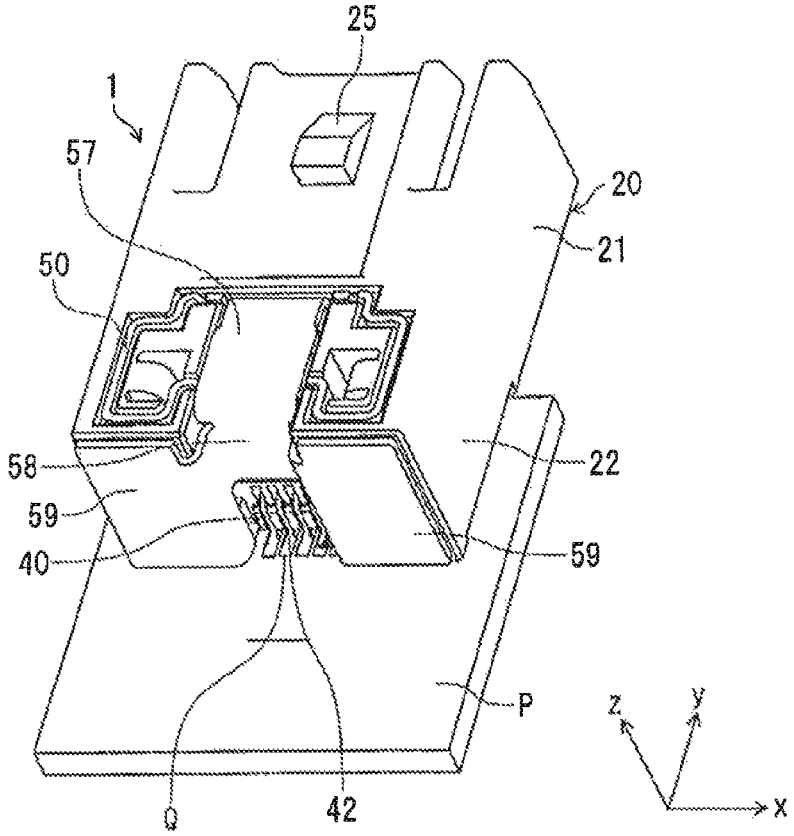
FIG. 5 is a perspective view of the electrical connector mounted on the circuit board according to the embodiment of the present invention as viewed from above and diagonally behind.
Figure 6:
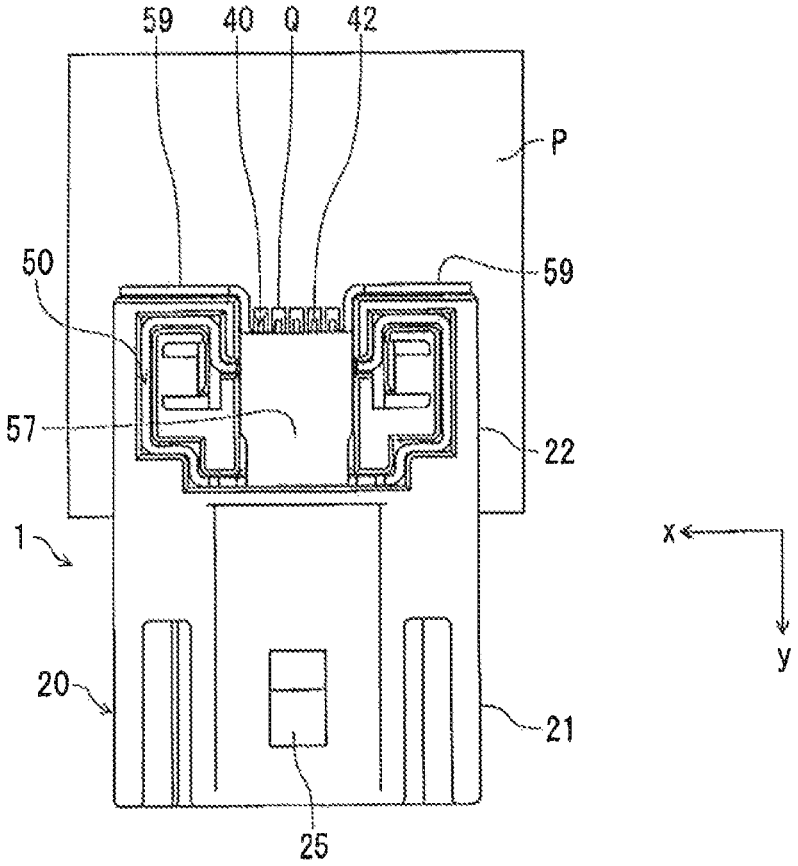
FIG. 6 is a plan view of the electrical connector mounted on the circuit board according to the embodiment of the present invention.
Figure 7:
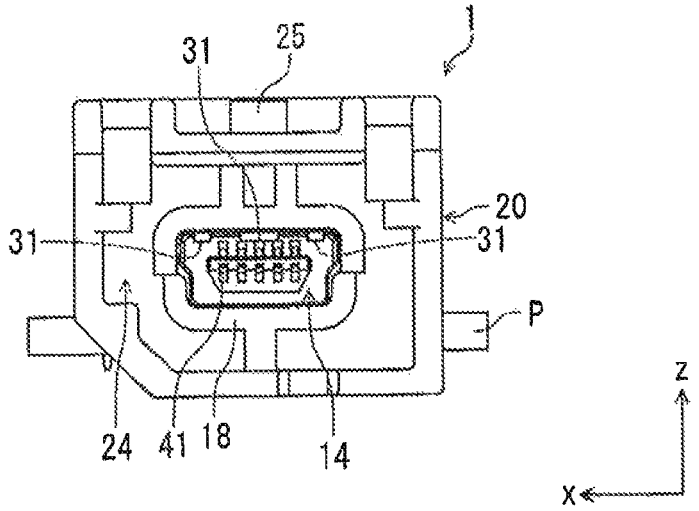
FIG. 7 is a front view of the electrical connector mounted on the circuit board according to the embodiment of the present invention.

An electrical connector according to an embodiment of the present invention will be described in detail below with reference to the drawings where necessary. In the drawings, an x-axis, a y-axis, and a z-axis constitute a three-axis Cartesian coordinate system. In the description, the positive direction of the y-axis corresponds to the forward direction, the negative direction of the y-axis corresponds to the backward direction, the x-axis direction corresponds to the left and right direction, the positive direction of the z-axis corresponds to the upward direction, and the negative direction of the z-axis corresponds to the downward direction.

<Overall Structure of Electrical Connector>

An overall structure of an electrical connector 1 according to the embodiment of the present invention will be described below in detail with reference to FIGS. 1 to 7.

The electrical connector 1 includes a first housing 10, a second housing 20, a shielding case 30, a contact 40, and a holddown 50. The first housing 10 and the second housing 20 may be integrally formed as a single housing. The shielding case 30 may not be provided.

The first housing 10 is made of an insulating material. The first housing 10 has a pair of guide parts 12 provided in left and right side walls and extending forward from a rear end, leg parts 13 extending from lower ends of the pair of guide parts 12 and fixed to a circuit board P, and an opening 14 provided in a front portion into which a counterpart connector is to be inserted. In a rear wall of the first housing 10, a plurality of openings 11 for leading the contact 40 to the outside are arranged at predetermined intervals. The first housing 10 has an opposed face 15 facing the circuit board P when placed on the circuit, board P.

The second housing 20 is made of an insulating material, and has a body part 22 to be placed on the circuit board P and a protruding part 21 protruding forward from the body part 22, which are integral with each other. When the second housing 20 is mounted on the circuit board P, the protruding part 21 protrudes from the circuit board P and can be engaged with a counterpart connector (see FIGS. 4 to 6). Note that the direction of engagement of the counterpart connector is the negative direction of the y-axis.

The body part 22 has opposed faces 23 facing the circuit board P when placed on the circuit board P. The second housing 20 is provided with a pair of locking parts 19 linearly extending downward from the left and right opposed faces 23. The locking parts 19 have locking pawls at lower ends thereof that engage with the guide parts 12 of the first housing 10. As a result of engagement of the guide parts :12 and the locking parts 19, upper ends of engagement pawls of the locking parts 19 and lower ends of the guide parts 12 are in contact with each other.

The body part 22 has grooves 26 formed downward in the upper face, and throughholes 27 formed vertically through bottoms of the grooves 26 and communicate with the grooves 26. The body part 22 has a contact part 16 resulting from the difference in the vertical length between the body part 22 and the protruding part 21.

The protruding part 21 has an opening 24 and an engagement piece 25 that engages with a counterpart connector to be inserted into the opening 24. The opening 24 is formed in the front-back direction and has a window surrounded by a frame 18 so as to expose the opening 14 of the first housing 10 in front.

At the back of the second housing 20, rear walls 28*a* and a rear wall 28*b* that is recessed forward relative to the rear walls 28*a* are formed, which form a recess 17.

The shielding case 30 is formed by punching a metal sheet, bent along the external shape of the first housing 10 and attached to first housing 10. The shielding case 30 is provided with tongue pieces 31 formed by punching out the metal sheet and bending the pieces downward, a pair of leg parts 32 linearly extending downward from left and right side walls, and bent parts 33 bent inward from left and right rear ends. The tongue pieces 31 partly protrude inside of the opening 11 when the shielding case 30 is attached to the first housing 10. The pair of leg parts 32 is soldered to be fixed to the circuit board P.

The shielding case 30 is fixed to the first housing 10 by bringing the rear ends of the leg parts 32 into contact with the front ends of the guide parts 12 of the first housing 10 and bringing the bent parts 33 and the rear face of the first housing 10 into contact with each other above the guide parts 12. The shielding case 30 suppresses superimposition of noise on a signal when the signal is passed between a conductive terminal of a counterpart connector engaged with the electrical connector 1 and the contact 40.

The contact 40 is formed by punching out a conductive metal sheet in long narrow strips and bending the strips, and attached to the first housing 10. The contact 40 has a first connection part 41 exposed inside of the opening 14 and connected to a conductive terminal, which is not shown, of a counterpart connector, and a second connection part 42 protruding out to the back from the opening 11 of the first housing 10 and soldered to a conductive part Q (see FIGS. 5 and 6) of the circuit board P.

The second connection part 42 is positioned closer to the front than the rear walls 28*a* of the second housing 20, The second connection part 42 protrudes rearward further than the rear wall 28*b* of the second housing 20 and can be viewed from above when soldered to the conductive part Q of the circuit board P since the second housing 20 is provided with the recess 17.

Since the second connection part 42 is positioned closer to the front than the rear walls 28*a* of the second housing 20, distortion of the second connection part 42 owing to an external force applied when the electrical connector 1 is mounted on the circuit board P or the like can be prevented by the left and right rear walls 28*a* as much as possible and the area in which the electrical connector 1 is mounted on the circuit board P can be made smaller.

The holddown 50 is made of a material having a high specific gravity such as brass. The holddown 50 is press fitted into the grooves 26 of the second housing 20 and held by the second housing 20. The holddown 50 is fixed to the circuit board P by soldering. The holddown 50 is both a member for fixing the second housing 20 to the circuit board P and a member for shifting the center of gravity backward. As a result, it is not necessary to provide an additional member for adjusting the center of gravity, the number of components is not increased, and it is thus possible to suppress increase in the manufacturing cost.

<Structure of Holddown>

Figure 8:
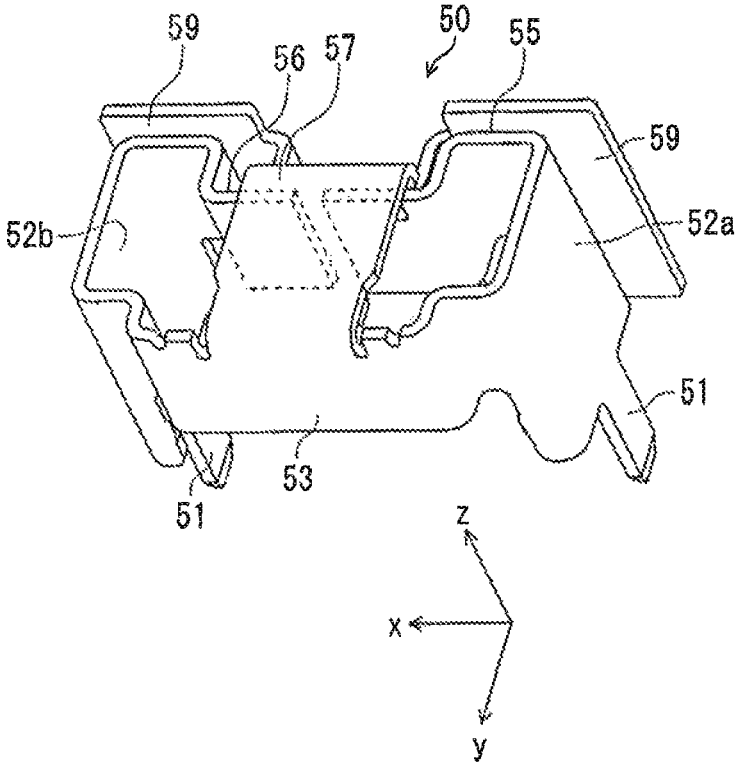
FIG. 8 is a perspective view of a holddown according to the embodiment of the present invention as viewed from above and a diagonal front.
Figure 9:
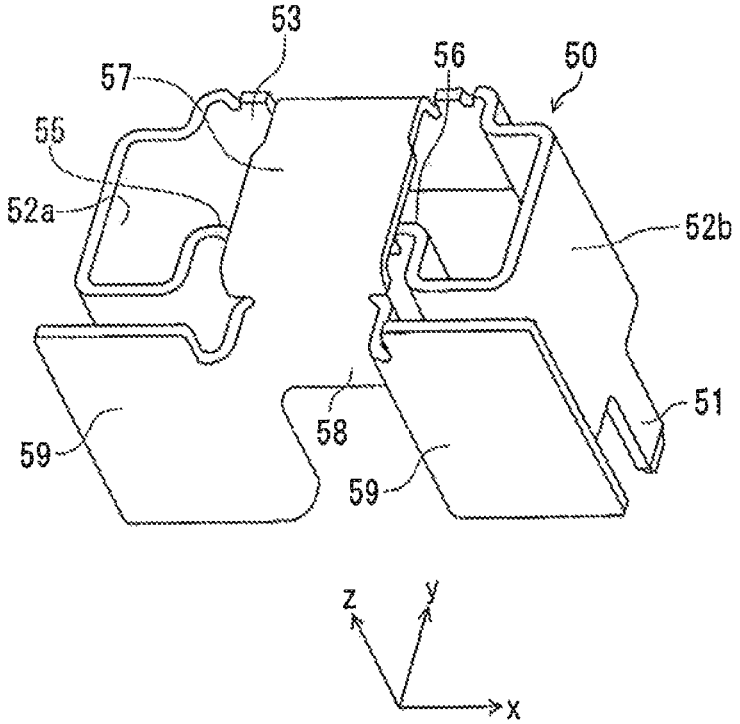
FIG. 9 is a perspective view of the holddown according to the embodiment of the present invention as viewed from above and diagonally behind.
Figure 10:
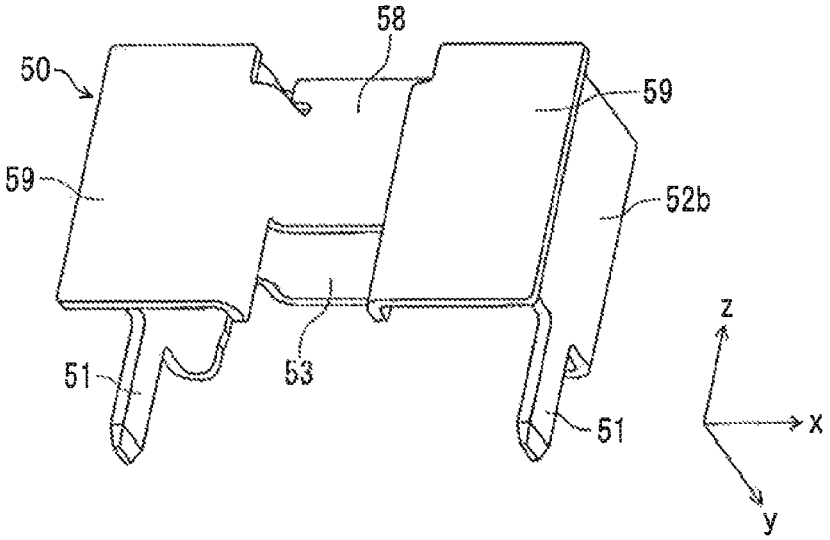
FIG. 10 is a perspective view of the holddown according to the embodiment of the present invention as viewed from below and diagonally behind.

The structure of the holddown 50 in the embodiment of the present invention will be described in detail below with reference to FIGS. 8 to 10.

The holddown 50 has a held part 60 held by the second housing 20, leg parts 51 linearly extending downward from the held part 60, and an extension part 54 extending rearward from the held part 60. The holddown 50 is formed in a manner that a single metal sheet is bent to integrally form the held part 60, the leg parts 51, and the extension part 54. As a result, the holddown 50 can be made of a single component in the present embodiment, which can reduce the number of components and can thus reduce the manufacturing cost as compared to the related art.

The held part 60 has a plurality of side walls 52*a* and 52*b*, a connecting portion 53 connecting the side wall 52*a* and the side wall 52*b*, an end portion 55 bent from a rear end of the side wall 52*a* to be opposed to the connecting portion 53, and an end portion 56 bent from a rear end of the side wall 52*b* to be opposed to the connecting portion 53.

The extension part 54 has a flat portion 57 exposed on an upper face of the body part 22 of the second housing 20 and being flat along the upper face, a bent portion 58 bent downward from the flat portion 57, and front end portions 59 extending leftward and rightward from the bent portion 58.

The leg parts 51 linearly extend downward from the respective side walls 52*a* and 52*b*. The leg parts 51 are inserted into the throughholes 27 of the second housing 20 from above, pass through the throughholes 27, protrude below the opposed faces 23, and are connected to the circuit board P by soldering. The pair of leg parts 51 protrudes downward from the opposed faces 23 with a distance in the left-right direction larger than that of the pair of leg parts 13 of the first housing 10 protruding downward from the opposed faces 23 and that of the pair of leg parts 32 of the shielding case 30. Since the leg parts 51 leg parts 51 have a plate-like shape, the area in which the leg parts 51 are fixed to the circuit board P can be minimized.

The side wall 52*a* is connected to the connecting portion 53 at the front end and connected to the end portion 55 at the rear end. The side wall 52*b* is opposed to the side wall 52*a*, connected to the connecting portion 53 at the front end and connected to the end portion 56 at the rear end. The side walls 52*a* and 52*b* are held by the second housing 20 in a state in which the width direction thereof is parallel to the direction in which the counterpart connector is engaged.

The connecting portion 53 is positioned closer to the front than the side walls 52*a* and 52*b*, the end portion 55, and the end portion 56, and held by the second housing 20 in a state in which the width direction thereof is parallel to the left-right direction.

The flat portion 57 is formed by being bent rearward further than the connecting portion 53. The flat portion 57 is positioned in the second housing 20 in a state in which the flat portion 57 is parallel to the upper face of the second housing 20 and in contact with the holding face 29 (see FIG. 1) of the upper face, and exposes on the upper face (the face opposite to the opposed faces 23) of the second housing 20.

The flat portion 57 has an area that can come into contact with a suction nozzle when the electrical connector 1 is automatically mounted on the circuit board P by sucking the electrical connector 1 and placing the electrical connector 1 on the circuit board P. The flat portion 57 is positioned in the second housing 20 to vertically overlap with the circuit board P when the electrical connector 1 is mounted on the circuit board P (see FIG. 6). As a result, even if the flat portion 57 is pressed downward by the suction nozzle when the electrical connector 1 is placed on the circuit board P, the body part 22 can be held between the circuit board P and the suction nozzle with the flat portion 57 therebetween, which can prevent the electrical connector 1 from tilting forward. Furthermore, since the flat portion 57 of the holddown 50 serves as the suction face for the suction nozzle and the second housing 20 need not be provided with a suction, it is possible to prevent the electrical connector 1 from becoming larger in size.

The bent portion 58 is formed by being bent downward further than the flat portion 57 and is positioned along the rear wall 28*b* of the second housing 20. Thus, when viewed from above, the second connection part 42 of the contact 40 is not hidden by the bent portion 58.

The front end portions 59 are formed by being bent leftward and rightward from the bent portion 58, and are positioned along the rear walls 28*a* of the second housing 20.

As a result of arranging the bent portion 58 along the rear wall 28*b* of the second housing 20 and arranging the front end portions 59 along the rear walls 28*a* of the second housing 20, the holddown 50 having a certain weight can be attached to the second housing 20 in a compact manner. Furthermore, as a result of covering the rear walls 28*a* with the front end portions 59 and covering the rear wall 28*b* with the bent portion 58, the strength at the back of the electrical connector 1 can be improved.

Figure 12:
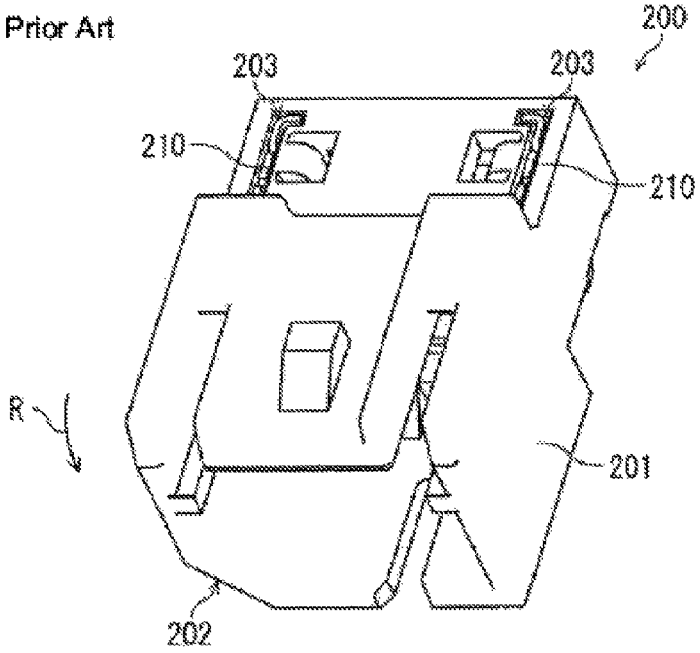
Fig. 12 Prior Art
FIG. 12 is a perspective view of an electrical connector of related art.
Figure 13:
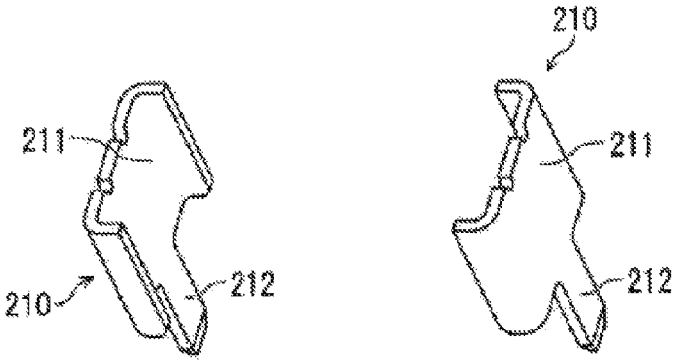
Fig. 13 Prior Art
FIG. 13 is a perspective view of holddowns of the related art.

As a result of attaching the holddown 50 having the above-described structure to the body part 22 of the second housing 20, the center of gravity can be shifted backward as compared to the electrical connector of the related art shown in FIG. 12. As a result, the electrical connector 1 has the center of gravity at the position where the electrical connector 1 vertically overlap with the circuit board P when the electrical connector 1 is placed on the circuit board P, and the electrical connector 1 does not tilt forward when placed on the circuit board P, which allows automatic mounting on the circuit board P without using any jig or the like for preventing tilting forward.

Note that the electrical connector 200 of the related art shown in FIG. 12 cannot be automatically mounted since the electrical connector 200 has the center of gravity at a position closer to the front and tilts forward when placed on a circuit board. Thus, with the electrical connector 200 of the related art, it is necessary to automatically mount an inner housing, which is not shown, that is separate from the housing 202 on the circuit board P first, and then manually mount the housing 202 to which the holddowns 210 are attached separately on the circuit board P, which makes the manufacturing process complicated and increases the manufacturing cost.

In contrast, with the electrical connector 1 according to the present embodiment, the center of gravity can be shifted rearward as a result of attaching the holddown 50 to the body part 22 and the first housing 10 and the second housing 20 to which the contact 40 is attached can be integrally formed and automatically mounted on the circuit board P, which does not increase the manufacturing cost.

<Method for Assembling and Method for Mounting Electrical Connector>

A method for assembling and a method for mounting the electrical connector 1 according to the embodiment of the present invention will be described in detail below with reference to FIGS. 1 to 10.

First, the contact 40 is press-fitted and fixed into the first housing 10, and the shielding case 30 formed by punching out a metal sheet is bent along the external shape of the first housing 10 and attached to the first housing 10.

Subsequently, the first housing 10 including the shielding case 30 and the contact 40 is engaged with the second housing 20 from below the second housing 20. Specifically, the first housing 10 is moved upward toward the second housing 20 so that the pair of locking parts 19 of the second housing 20 are brought into contact with the pair of guide parts 12 of the first housing 10, respectively, and are thus elastically deformed outward to the left and to the right. When the guide parts 12 pass the locking pawls of the locking parts 19, the locking parts 19 then return inward to the right and to the left by the elastic returning force, and the locking parts 19 and the guide parts 12 engage with each other in a state in which the lower ends of the guide parts 12 and the upper ends of the locking pawls of the locking parts 19 are in contact with each other.

Subsequently, the holddown 50 is press-fitted into the grooves 26 of the second housing 20 from above so that the pair of leg parts 51 of the holddown 50 pass through the throughholes 27 formed in the second housing 20 and protrude downward from the opposed faces 23 and the holddown 50 is held by the second housing 20. In this manner, the assembly of the electrical connector 1 is completed.

Since the front end portions 59 of the holddown 50 hide the engagements of the guide parts 12 and locking parts 19 as viewed from behind (see FIG. 3), the front end portions 59 can serve as stoppers and prevent the first housing 10 from coming off the second housing 20 rearward even when a strong external force is applied to the first housing 10 from the front before the electrical connector 1 mounted on the circuit board P.

Subsequently, the flat portion 57 of the holddown 50 attached to the second housing 20 is sucked by the suction nozzle and the electrical connector 1 is conveyed onto the circuit board P on which the electrical connector 1 is to be mounted.

Subsequently, while sucking the flat portion 57 with the suction nozzle, the body part 22 is placed on the circuit board P in a state in which the contact part 16 formed at the body part 22 of the second housing 20 is in contact with an end part of the circuit board P.

A solder paste is applied to the conductive part Q of the circuit board P in advance, and the second connection part 42 of the contact 40 is placed on the solder paste. The flat portion 57 is slightly pressed downward by the suction nozzle to press the second connection part 42 of the contact 40 against the solder paste of the circuit board P. In this process, since the second housing 20 is held between the suction nozzle and the circuit board P with the flat portion 57 therebetween, the electrical connector 1 can be prevented from tilting forward.

When the electrical connector 1 is placed on the circuit board P, the leg parts 51 of the holddown 50 pass through throughholes, which are not shown, formed in advance in the circuit board P, and are soldered onto the back face of the circuit board P by DIP soldering and fixed to the circuit board P. Furthermore, the leg parts 13 of the first housing 10 pass through throughholes, which are not shown, in the circuit board P so that the electrical connector 1 is positioned, and the leg parts 32 of the shielding case 30 are fixed and connected to a ground, which is not shown, of the circuit board P by soldering.

Subsequently, suction of the flat portion 57 by the suction nozzle is released, and the electrical connector 1 placed on the circuit board P is conveyed into a reflow furnace under a high temperature environment. As a result, the solder paste on the circuit board P is molten, the second connection part 42 of the contact 40 and the conductive part Q of the circuit board P are electrically connected, and the second connection part 42 is fixed to the conductive part Q. In this manner, mounting of the electrical connector 1 onto the circuit board P is completed.

Finally, the electrical connector 1 mounted on the circuit board P is imaged from above by a camera to check the connection state of the second connection part 42 of the contact 40 and the conductive part Q of the circuit board P by using image recognition. In this process, since the recess 17 allowing the second connection part 42 to be viewed from above is provided in the second housing 20, the connection state of the second connection part 42 and the conductive part Q can be easily imaged from above by a camera. Since inspection of solder failure or the like between the second connection part 42 and the conductive part Q can thus be conducted using image recognition, the inspection process can be labor-saving.

Modified Example 1

Figure 11:
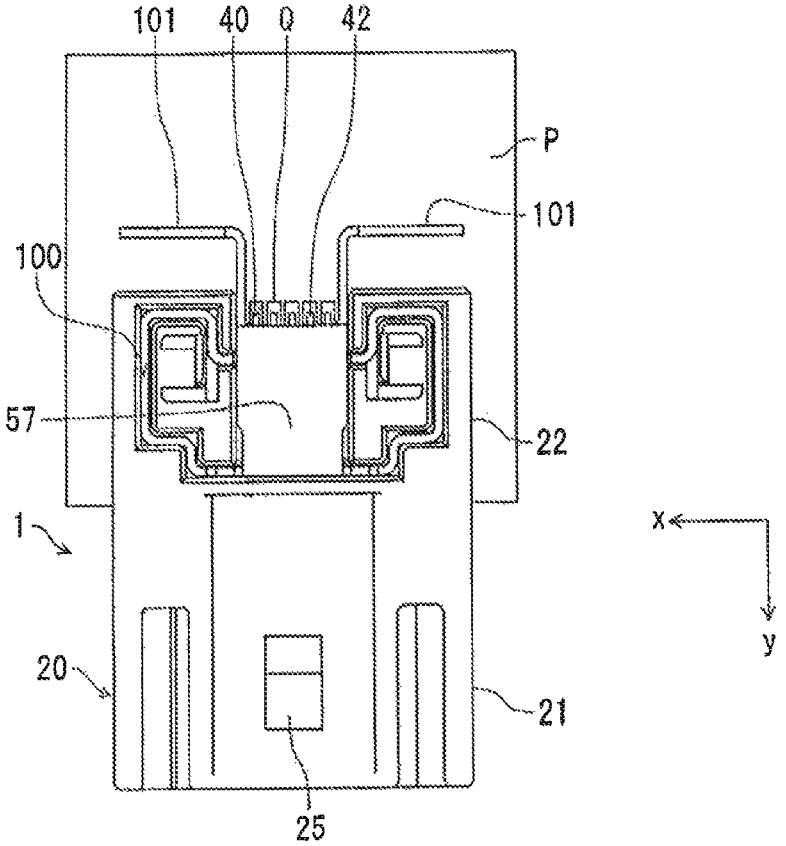
FIG. 11 is a plan view of an electrical connector mounted on a circuit board according to a modified example 1 of the embodiment of the present invention.

A modified example 1 of the electrical connector according to the embodiment of the present embodiment will be described below in detail with reference to FIG. 11. In FIG. 11, a holddown 100 is used in place of the holddown 50 in FIGS. 1 to 10. In FIG. 11, since the structure other than the holddown 100 is the same as that in FIGS. 1 to 7, the description thereof will not be repeated. Furthermore, parts of the holddown 100 that are the same as those of the holddown 50 will be designated by the same reference numerals and the description thereof will not be repeated.

As shown in FIG. 11, the holddown 100 has front end portions 101 at further rear positions than the front end portions 59 of the holddown 50. As a result, the center of gravity of the electrical connector can be further shifted backward, which allows the electrical connector to be placed more stably on the circuit board.

The positions in the front-back direction where the front end portions 101 are placed can be changed where necessary according to the center of gravity required for the electrical connector. Furthermore, with the simple structure for only adjusting the positions of the front end portions 101 of the holddown 100 at the back, the center of gravity of the electrical connector can be easily adjusted. In addition, since the shape of the held part 60 of the holddown 100 is not changed from that of the holddown 50, the center of gravity of the electrical connector can be adjusted without changing the shape of the second housing 20.

Modified Example 2

While the contact is connected to the conductive part of the circuit board by surface mounting in the embodiment and the modified example 1 described above, a contact through which throughholes formed in the circuit board P pass may be soldered on the rear face of the circuit board. In this case, since the electrical connector does not tilt forward when placed on the circuit board, the electrical connector need not be pressed with a hand or a jig, which can make soldering work easier and produce the same effects as those when soldering is conducted using surface mounting Modified Example 3

While the extension part 54 of the holddown 50 or 100 extending rearward from the held part 60 is provided in the embodiment, the modified example 1, and the modified example 2 described above, the extension part 54 may extend forward from the held part 60. Specifically, the extension part of the holddown can extend from the held part 60 in a direction parallel to the direction in which the counterpart connector is engaged.

It will be appreciated that the types, arrangements, numbers, and the like of components in the present invention are not limited to those in the embodiment described above, in addition to the modified example 1 and the modified example 2, but can be changed where appropriate, in such a manner that certain components are replaced by those producing the same effects where appropriate, without departing from the scope of the invention.

For example, the shape of the held part of the holddown is not limited to that in the embodiment described above but may be any shape that can be held in the second housing. Note that the holddown can be made heavier as the shape of the held portion is larger, which allows the electrical connector to be placed more stably on the circuit board.

Industrial Applicability

The present invention is suitable for an electrical connector having a holddown attached to a housing and fixed to a circuit board.

REFERENCE SIGN LIST

1 electrical connector
10 first housing
12 guide part
13 leg part
14 opening
17 recess
18 frame
19 locking part
20 second housing
21 protruding part
22 body part
23 opposed face
40 contact
41 first connection part
42 second connection part
50 holddown
51 leg part
54 extension part
57 flat portion
60 held part
P circuit board
Q conductive part

What is claimed is:

1. An electrical connector comprising:

an insulating housing having a body part placed on a circuit board, and a protruding part protruding from the body part and adapted to be engaged with a counterpart connector;

a conductive contact having a first connection part to be connected to a conductive terminal of the counterpart connector and a second connection part connected to a conductive part of the circuit board, and attached to the housing; and a holddown attached to the body part and fixed to the circuit board, wherein the holddown is formed of a single metal sheet, and includes a held part held by the body part, a leg part extending from the held part, protruding from an opposed face of the placed body part facing the circuit board, and being fixed to the circuit board, and an extension part extending from the held part in a direction parallel to a direction in which the counterpart connector is engaged.

2. The electrical connector according to claim 1, wherein the extension part has a flat portion exposed on a face of the housing opposite to the opposed face and being flat along the opposite face.

3. The electrical connector according to claim 1, wherein the second connection part of the contact is connected to the conductive part of the circuit board through surface mounting, and the housing has a recess allowing the second connection part connected to the conductive part of the circuit board to be viewed from above.

4. The electrical connector according to claim 2, wherein the second connection part of the contact is connected to the conductive part of the circuit board through surface mounting, and the housing has a recess allowing the second connection part connected to the conductive part of the circuit board to be viewed from above.

* * * * *